US007798783B2

(12) United States Patent
Burns et al.

(10) Patent No.: US 7,798,783 B2
(45) Date of Patent: Sep. 21, 2010

(54) MAGNETICALLY DRIVEN VALVELESS PISTON PUMPS

(75) Inventors: Stephen Michael Burns, Portland, OR (US); Jeffrey Glenn Barton, The Dalles, OR (US); Charles F. Carr, Battleground, WA (US)

(73) Assignee: Micropump, Inc., Vancouver, WA (US)

( * ) Notice: Subject to any disclaimer, the term of this patent is extended or adjusted under 35 U.S.C. 154(b) by 1162 days.

(21) Appl. No.: 11/400,168

(22) Filed: Apr. 6, 2006

(65) Prior Publication Data

US 2007/0237658 A1 Oct. 11, 2007

(51) Int. Cl.

| | |
|---|---|
| ***F04B 49/06*** | (2006.01) |
| ***F04B 35/04*** | (2006.01) |
| ***F04B 7/06*** | (2006.01) |
| ***H02K 41/02*** | (2006.01) |

(52) U.S. Cl. ..... 417/53; 417/415; 417/416; 417/500; 310/12.14

(58) Field of Classification Search ..... 417/415, 417/416, 490, 500, 53; 310/12.14, 24, 15, 310/23

See application file for complete search history.

(56) References Cited

U.S. PATENT DOCUMENTS

| | | | | |
|---|---|---|---|---|
| 4,234,831 | A * | 11/1980 | Kemmer et al. | 318/115 |
| 4,607,197 | A * | 8/1986 | Conrad | 318/116 |
| 5,961,303 | A * | 10/1999 | King | 417/492 |
| 6,051,896 | A * | 4/2000 | Shibuya et al. | 310/12.14 |
| 6,891,287 | B2 | 5/2005 | Moret | |

* cited by examiner

*Primary Examiner*—Charles G Freay
(74) *Attorney, Agent, or Firm*—Klarquist Sparkman, LLP

(57) ABSTRACT

Valveless piston pumps are disclosed that are magnetically driven, thereby eliminating a troublesome dynamic seal used on conventional valveless piston pumps. An exemplary embodiment includes a housing defining a bore having a bore axis. A piston is situated in the bore so as to be movable in the bore in a reciprocating manner along the bore axis and in a rotational manner about the bore axis. A magnet is situated in the bore and is coupled to the piston. The magnet is engageable magnetically with a magnet-driving device configured to cause the magnet, and thus the piston, to move in the reciprocating manner and in the rotational manner. An exemplary magnet-driving device is a stator assembly.

19 Claims, 5 Drawing Sheets

MAGNETICALLY DRIVEN VALVELESS PISTON PUMPS

FIELD

This disclosure pertains to, inter alia, pumps and pumping methods for urging flow of liquids and other fluids in a hydraulic system. The disclosure includes descriptions of piston pumps that urge fluid flow by motion of a piston relative to a housing such as a cylinder. More specifically, the disclosure includes descriptions of "valveless" piston pumps that control input of fluid to and output of fluid from the housing by action of the piston itself.

BACKGROUND

For urging flow of and/or for pressurizing fluids, pumps are available in a large variety of configurations, most of which are specific for their respective applications. One general group of pumps used particularly in certain fluid-dispensing applications is "metering pumps," which are configured for moving precise volumes of fluid accurately in specified time periods. Examples of metering pumps include piston pumps, syringe pumps, diaphragm pumps, bellows pumps, and peristaltic pumps. Because piston pumps are generally positive-displacement, even against substantial back-pressure, they are very effective for performing accurate delivery of many types of liquids.

Most types of piston pumps and syringe pumps (the latter actually being a subset of piston pumps) include at least one piston that urges fluid flow by undergoing a series of paired, alternating linear strokes. Each pair of strokes includes an intake stroke and a discharge stroke. The piston extends through a dynamic seal into a housing. During the intake (suction) stroke, the piston is pulled or otherwise moved relative to the housing so as to draw fluid into the housing via an inlet port. During the discharge stroke, the piston is pushed or otherwise moved relative to the housing so as to displace fluid from the housing via an outlet port. The inlet port and outlet port usually are controlled by respective valves that open and close at appropriate moments to control fluid movement into and out of the pump during the respective strokes. (The valves are not necessarily located immediately at the inlet and outlet ports.) In piston pumps in which the piston undergoes reciprocating linear motion relative to the housing, the piston can be actuated by any of various mechanical means or electromechanical means (e.g., motor-and-gear mechanisms or solenoid mechanisms, respectively).

Whereas metering pumps that include discrete inlet and outlet valves are satisfactory for many applications, problems become manifest when such pumps are used in certain other applications. Exemplary problematic applications are the pumping of viscous liquids and thick liquid suspensions such as food ingredients and certain industrial liquids such as liquid adhesives, resins, paints, concentrates, and the like. Many viscous liquids and liquid suspensions interfere with proper functioning of valve seals and valve seats, especially over time, which can degrade the desired positive-displacement pumping action as well as pumping accuracy and precision. Other disadvantages, especially with pumping of liquid food substances and other sanitary liquids, are the ease with which valves become contaminated and the inherent difficulty of cleaning and disinfecting valve mechanisms to ensure consistently hygienic pumping action.

To address the valve problem summarized above, so-called "valveless piston" pumps have been developed that effectively eliminate inlet and outlet valves by incorporating valving action in the motion of the piston. A conventional valveless piston pump 200, shown in FIG. 6, comprises a piston 202, a piston housing 204, a dynamic seal 206, a motor 208 (with armature 210 and shaft 212), and a rotational coupling 214. The piston housing 204 comprises an inlet port 216 and an outlet port 218. The piston 202 is cylindrical, extends along a piston axis $A_p$, and slip-fits into a bore 220 defined in the housing 204 (or in a liner 205 situated in the housing, as shown). The piston 202 comprises a proximal end 222 and a distal end 224. The distal end 224 has a flat 226 or analogous cutout that extends part-way around the circumference of the distal end 224 and is situated inside the bore 220 during operation. The proximal end 222 comprises a pin 228 extending substantially perpendicularly to the piston axis $A_p$.

Even though the piston 202 slip-fits into the bore 220, the dynamic seal 206 is required because the slip fit does not isolate the bore from the external environment sufficiently to prevent leaks and troublesome accumulation of dried or congealed fluid. The dynamic seal 206 forms a sliding seal circumferentially around the piston 202 in a region of the piston between the flat 226 and the proximal end 222, and allows both reciprocating motion (along the piston axis $A_p$; arrow 225) and rotational motion (about the piston axis $A_p$; arrow 227) of the piston in and relative to the bore 220.

The rotational coupling 214 comprises a proximal end 230 and a distal end 232 arranged at substantially right angles to each other. The distal end 232 comprises a spherical bearing 234 that receives the pin 228 and allows rotation of the pin relative to the coupling 214. The proximal end 230 of the coupling 214 is attached to the shaft 212 of the motor armature 210 so as to undergo rotation about the motor axis $A_m$ whenever the armature is rotating. Energization of the motor 208 causes rotation of the armature 210.

As noted above, during operation the piston 202 undergoes both rotational and reciprocating motion in the bore 220. The rotational motion is a direct result of rotation of the motor armature 210. To achieve the accompanying reciprocating motion the piston axis $A_p$ is angled (at an appropriate "obtuse" angle, i.e., greater than 90° but less than 180°) relative to the motor axis $A_m$. Thus, as the armature 210 rotates about the motor axis $A_m$, the piston 202 undergoes synchronous rotation and reciprocation in the bore 220.

The particular configuration of the distal end 224 of the piston 202 serves two functions. First, in the bore 220 the flat 226 defines a pathway for fluid being aspirated into the bore via the inlet port 216 and a pathway for fluid being discharged from the bore via the outlet port 218 as the piston 202 undergoes reciprocating motion. Second, as the piston 202 is being rotated in the bore 220 about the piston axis $A_p$, the remaining (not flatted) portion of the distal end 224 periodically opens and closes the inlet port 216 and the outlet port 218 in a synchronous manner relative to the reciprocating motion of the piston. Thus, the inlet port 216 is opened (and the outlet port 218 is closed) during a time increment in which the piston 202 can aspirate fluid into the bore 220 via the inlet port, and the inlet port 216 is closed (and the outlet port 218 is opened) during a subsequent time increment in which the piston 202 expels fluid from the bore via the outlet port.

The length of the "stroke" undergone by the piston 202 in the bore 220 is determined by the obtuse angle of the piston axis $A_p$ relative to the motor axis $A_m$. Within a defined range, the smaller the angle, the longer the stroke and the greater the pumping rate exhibited by the pump 200 at a given reciprocation rate. The stroke is zero at an angle of 180° (i.e., when the axes $A_p$, $A_m$ are parallel to each other) and is at a functional maximum at an angle of about 135° to 150°. Angles less than about 135° impart a stroke that is too long. I.e., an excessively long stroke results in the piston 202 being pulled too much out of the bore 220, which causes the piston 202 to open both the inlet port 216 and the outlet port 218 simultaneously and thus stop pumping action (which requires the synchronous alternating opening and closing of the ports relative to the reciprocating motion of the piston). Also, an excessively long stroke applies excessive strain to the dynamic seal 206 and the spherical bearing 234.

Conventional valveless piston pumps as summarized above are effective metering pumps for many uses, particularly in view of their lack of valves and their ability to achieve positive-displacement pumping even of viscous liquids. Unfortunately, however, conventional valveless piston pumps are problematic when used for certain other applications. The main reason for this shortcoming is the dynamic seal 206, which is prone to leaks, tends to harbor contamination, and is difficult and time-consuming to clean (which frequently must be performed in situ). The dynamic seal 206 also inherently has low reliability and thus requires frequent servicing or replacement relative to other parts of the pump 200. These disadvantages are particularly important in valveless piston pumps being considered for use in food- and medicament-dispensing applications.

Therefore, there is a need for valveless piston pumps that do not have a dynamic seal.

SUMMARY

The foregoing need is met by, inter alia, various aspects of piston pumps and methods as disclosed herein.

According to a first aspect, piston pumps are disclosed. An embodiment of such a piston pump comprises a housing, a piston, and a magnet. The housing defines a bore having a bore axis. The piston is situated in the bore so as to be movable in the bore in a reciprocating manner along the bore axis and in a rotational manner about the bore axis. The magnet is situated in the bore and is coupled to the piston. The magnet is engageable magnetically with a magnet-driving device configured to cause the magnet, and thus the piston, to move in the reciprocating manner and in the rotational manner.

This piston-pump embodiment further can comprise a magnet-driving device situated outside the housing. The magnet-driving device can be, for example, a stator assembly situated coaxially with the magnet outside the housing.

Another embodiment of a piston pump comprises a housing, a piston, a magnet, and a magnet cup. The housing defines a bore that extends along an axis, and has an inlet port and an outlet port extending into the bore. The piston is situated coaxially in the bore in a manner allowing the piston to undergo, in the bore, rotational motions about the axis and reciprocating motions along the axis. The reciprocating motions correspond to alternating intake strokes and discharge strokes of the piston. The rotational motions allow the piston to open and close the inlet and outlet ports in coordination with the intake and discharge strokes. The magnet is mounted to the piston and produces a magnetic field. The magnet cup defines a bore enclosing the magnet, wherein the magnet cup is attached to the housing such that the bore of the housing is contiguous with the bore of the magnet cup. The magnetic field of the magnet is engageable with a magnet-driving device located outside the magnet cup.

This piston-pump embodiment further can comprise a magnet-driving device that is located outside the magnet cup and that is magnetically coupled to the magnetic field produced by the magnet inside the magnet cup. The magnet-driving device can be configured to cause the coordinated reciprocating and rotational motions of the magnet, and thus of the piston in the bore. The magnet-driving device can comprise a stator assembly that comprises at least two stator portions each comprising at least two windings. The stator portions desirably are situated coaxially outside the magnet cup at respective locations along the axis so as magnetically to engage the magnet and to cause, when the stator portions and their respective windings are energized in a coordinated manner, the corresponding coordinated reciprocating and rotational motions of the piston in the bore.

The magnet cup desirably is sealed to the housing. For this purpose, a static seal can be situated between the magnet cup and the housing. The magnet desirably is axially mounted to the piston.

Each stator portion desirably has at least one shaded pole or analogous feature to ensure consistent directional rotation of the magnet and piston.

The piston advantageously has a cylindrical configuration that desirably slip-fits into a cylindrical bore. The bore desirably is contiguous with the bore of the magnet cup along the axis. Further desirably, a proximal end of the piston is coupled to the magnet, and a distal end is configured to open and close the inlet and outlet ports in an alternating manner in synchrony with the intake and discharge strokes.

The piston pump desirably further comprises means for limiting the axial stroke length of the piston. Such means can be, for example, one or more bumpers and/or collars on the magnet/piston or on nearby structure that arrest the axial travel of the piston. Another means can be configured as a cam and follower. Such means can be especially advantageous if the pump is to be used for pumping viscous fluids.

Another piston-pump embodiment comprises housing means, piston means, driven-magnet means, and magnet-driving means. The housing means is for defining a bore having a bore axis and for defining an inlet into the bore and an outlet from the bore. The piston means is situated in the bore in a manner allowing movement in a reciprocating manner along the bore axis and in a rotational manner about the bore axis. The piston means is for producing with such movements a coordinated positive-displacement pumping action that moves fluid into the bore via the inlet and delivers fluid from the bore via the outlet. The driven-magnet means is coupled to the piston means and is for imparting the movements to the piston means in the bore. The magnet-driving means is magnetically coupled to the driven-magnet means and is for imparting the movements to the driven-magnet means and hence to the piston means in the bore, to produce the coordinated positive-displacement pumping action. The magnet-driving means can comprise stator means located outside the housing means coaxially with the bore axis.

According to another aspect, methods for moving fluid are provided. An embodiment of such a method comprises moving a piston, in a bore having an axis, (a) about the axis so as to open an inlet into the bore, (b) along the axis in the bore so as to draw fluid into the bore via the inlet, (c) about the axis so as to close the inlet and open an outlet from the bore, and (d) along the axis so as to expel fluid from the bore via the outlet. The piston is magnetically coupled to a correspondingly movable magnetic field outside the bore to impart these motions to the piston in the bore in a coordinated manner about the axis and along the axis.

Magnetically coupling the piston to the movable magnetic field outside the bore can comprise attaching the piston to a magnet in the bore, and magnetically coupling the magnet to the movable magnetic field outside the bore. The magnet can be coupled to a movable magnetic field produced by a stator assembly arranged along the axis outside the bore.

The foregoing and additional features and advantages of the invention will be more readily apparent from the following detailed description, which proceeds with reference to the accompanying drawings.

DETAILED DESCRIPTION

This disclosure is set forth in the context of representative embodiments that are not intended to be limiting in any way. The representative embodiments include valveless piston-pump assemblies that are magnetically driven internally so as to eliminate the dynamic seal present in conventional valveless piston pumps. The present disclosure is directed toward all novel and non-obvious features and aspects of these and other embodiments, alone and in various combinations and sub-combinations with one another. The disclosed technology is not limited to any specific aspect or feature, or combination thereof, nor do the disclosed embodiments require that any one or more specific advantages be present or problems be solved.

Figure 1:
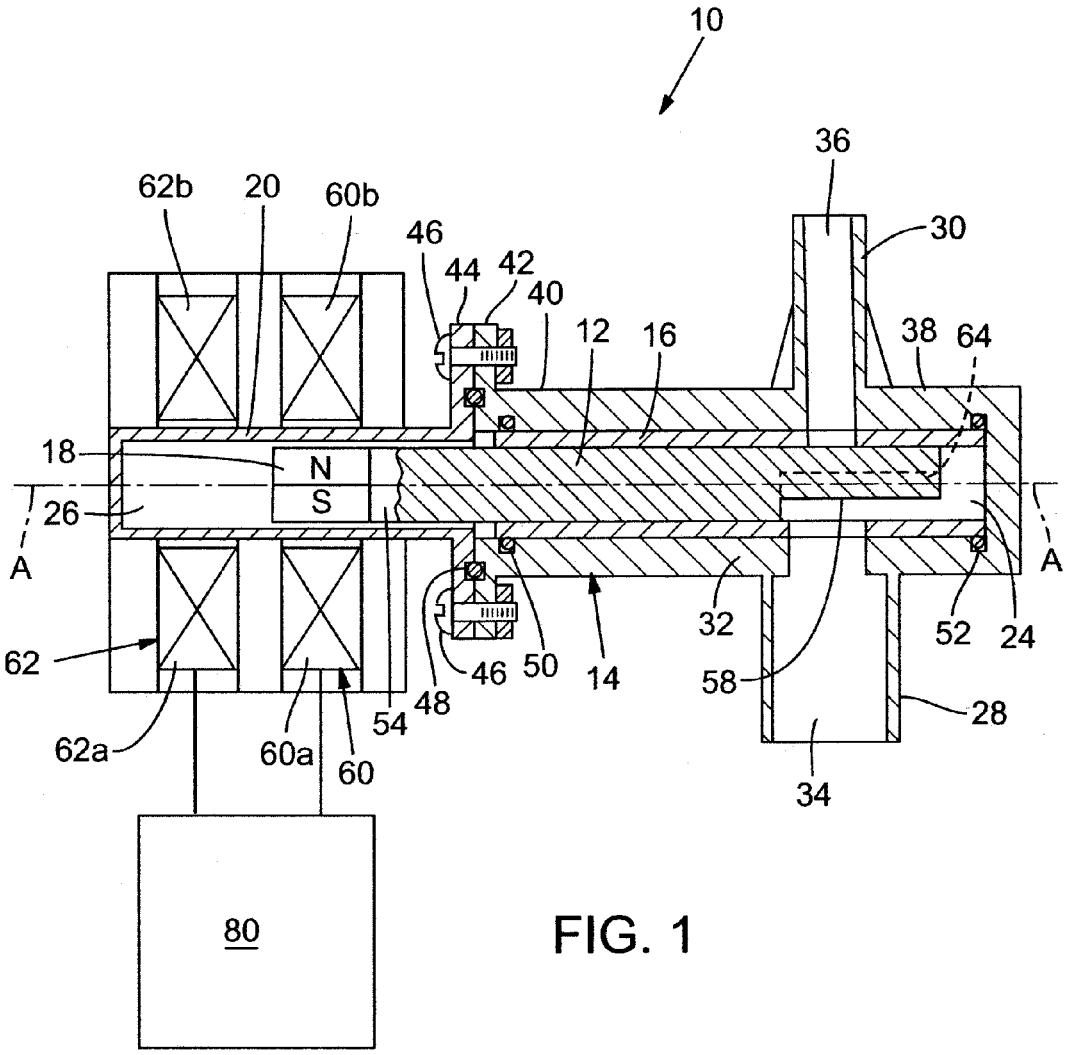
FIG. 1 is a sectional view of a valveless piston pump according to a representative embodiment.

A representative embodiment of a valveless piston-pump assembly 10, in which the dynamic seal has been eliminated by making the pump magnetically driven, is shown in FIG. 1. In general, the pump assembly 10 comprises a piston 12, a pump housing 14, a liner 16, a magnet 18, a magnet cup 20, and a motor stator assembly 22. The liner 16 is enclosed within the housing 14 and defines a bore 24 for the piston 12. The housing 14 and the magnet cup 20 are sealingly connected to form a sealed pump housing assembly. The housing 14 and liner 16 normally are stationary during use, and the magnet 18 is axially coupled to the piston 12 so that motion of the magnet is imparted directly to the piston. The magnet cup 20 defines a bore 26 that encloses the magnet 18, and the motor stator assembly 22 is situated outside the magnet cup 20 so as to surround the magnet cup coaxially. In this embodiment the piston 12, liner 16, housing 14, magnet 18, magnet cup 20, and motor stator 22 are all arranged substantially coaxially to the axis A.

The housing 14 includes an inlet port 28 and an outlet port 30. The inlet and outlet ports 28, 30 define respective passageways that extend (e.g., orthogonally to the axis A as in the depicted embodiment) through the wall 32 of the housing and through the liner 16 to the bore 24. If desired, the inlet port 28 has a lumen 34 that is larger than the lumen 36 of the outlet port 30, as shown, to facilitate ready intake of viscous fluids.

The liner 16 desirably is made of the same material (e.g., stainless steel or ceramic) as the piston 12. The bore 24 is analogous to a "cylinder" into which the piston 12 is coaxially situated in a slip-fit manner that allows the piston 12 to move, with reduced friction, in the bore along and about the axis A.

The housing 14 and liner 16 collectively have a first end 38 and a second end 40. The first end 38 is typically closed, and the inlet port 28 and outlet port 30 are situated near the first end. The second end 40 includes a mounting flange 42. Similarly, the magnet cup 20 includes a mounting flange 44 by which the magnet cup is mounted to the mounting flange 42 using screws 46 as shown or alternatively any of various other mechanical fasteners. As the magnet cup 20 is being assembled to the housing 14, a static seal 48 (e.g., an O-ring) is placed between the mounting flanges. Thus, the bore 26 of the magnet cup 20 becomes integral with the bore 24 of the liner 16, along the axis A, and the combined bores 24, 26 are sealed from the external environment without contacting or interfering with motion of the piston 12 or magnet 18.

The liner 16 can be removably slip-fitted into the housing 14 or permanently inserted into the housing. In instances in which the liner 16 is slip-fitted into the housing 14, static seals 50, 52 (e.g., respective O-rings) can be employed between the liner and the housing, such as shown in FIG. 1, to prevent contaminant incursion between the liner and the housing. Mounting the liner 16 permanently in the housing 14 can be achieved by any of various methods such as by making the liner and housing as an integral unit out of the same material, by casting the housing around the liner so as to bond the housing to the outside of the liner, or by potting the liner in the housing using a suitable adhesive.

As noted above, a combined cylindrical bore 24, 26 is formed by attaching the magnet cup 20 to the housing 14. The cylindrical piston 12 is slip-fit into the bore 24 in a manner allowing both linearly reciprocating (along the axis A) and rotational motion (about the axis A) of the piston relative to the bore. The cylindrical magnet 18 is situated in the bore 26 in a manner allowing both linear reciprocating (along the axis A) and rotational motion (about the axis A) of the magnet relative to the bore. Since the magnet 18 is coupled directly to the piston 12, any motion of the magnet is directly translated to a corresponding motion of the piston.

In the depicted embodiment the magnet 18 is configured with diametrically opposed "north" and "south" poles, which can be of a single magnet or of multiple magnet segments collectively forming the two poles. (Alternatively, in other embodiments, the magnet comprises more than two poles, such as four poles oriented at 90° to each other.) The magnet 18 (or magnet segments) can be made of any suitable magnet material. Exemplary magnet materials are bonded or sintered $SmCo_5$ (samarium cobalt), ceramic ("ferrite"; strontium carbonate+iron oxide), AlNiCo (aluminum-nickel-cobalt, or "alnico"), and bonded or sintered NdFeB (neodymium-iron-boron). NdFeB is especially desirable due to its very high magnetic strength per unit mass. Sintering is more desirable than bonding because sintering produces stronger magnets. Since these magnetic materials are readily corroded by exposure to air and to many liquids, the magnet desirably is plated with at least one layer of a corrosion-resistant material such as Ni. For example, in one embodiment, the magnet is made of NdFeB and is plated three times: first with Ni (200 μin thick), then with Cu (100-300 μin thick), then again with Ni (200 μin thick). An exemplary Ni-plating standard is ASTM 733B, Type V. An exemplary Cu-plating standard is AMS 2418, class 1.

The magnet 18 can be attached to the piston 12 by adhesive bonding or by other suitable means such as, for example, use of one or more mechanical fasteners, encapsulating the magnet to the end of the piston, threading the magnet onto the end of the piston, or pinning the magnet onto the end of the piston. The means used for attaching the magnet 18 desirably is unaffected by the particular liquid(s) intended to be pumped by the pump 10.

The piston 12 can be made of any suitable rigid material that is inert to the liquid(s) to be pumped by the pump 10 and that exhibits satisfactory dimensional stability and reliability. By way of example, particularly satisfactory materials for the piston 12 are ceramic and stainless steel. Suitably rigid and durable polymeric materials or glassy materials alternatively can be used. The polymer can be reinforced with fibers or particles if desired. As noted above, the piston 12 and liner 16 desirably are made of the same material.

The housing 14 and magnet cup 20 can be made of any suitable material such as, but not limited to, a rigid metal (desirably a metal that does not corrode in the presence of the fluid being pumped), a ceramic material, or a rigid polymeric ("plastic") material. These components need not be made of the same material. For example, the housing 14 can be made of a metal and the magnet cup 20 can be made of a rigid polymer, or vice versa, or alternatively they can be made of different polymers. Specific examples of candidate materials include, but are not limited to, stainless steel, aluminum alloy, polyetheretherketone (PEEK), poly(p-phenylene sulfide) (PPS), and polyimide. The plastics can be molded and/or machined, and can be reinforced with any of various suitable fibers or particles.

The static seal 48 between the liner 16 and magnet cup 20 (and any other static seals as required) can be any of various suitable configurations as generally known in the art such as gaskets, O-rings, and the like. An O-ring seal is advantageous because it works well for a long period of time without any attention, and is easily cleaned or replaced if required. Particularly suitable materials for O-ring static seals (or for other configurations of static seals) are elastomers such as silicone rubber, Viton, and buna-N. The particular elastomer or other material used for forming seals desirably is resistant to the fluid to be pumped.

The piston 12 comprises a proximal end 54 and a distal end 56. The proximal end 54 is axially coupled to the magnet 18, as described above. The distal end 56, extending toward the first axial end 38 of the housing, has a flat 58 or analogous cutout that extends part-way around the circumference of the distal end. The particular configuration of the distal end 56 of the piston 12 serves two functions. First, in the bore 24 the flat 58 defines a passageway by which fluid is aspirated through the inlet port 28 and fluid is discharged through the outlet port 30 as the piston 12 undergoes linear reciprocating motion along the axis A in the bore 24. Second, rotation of the piston 12 in the bore 24 about the axis A results in the remaining (not flatted) portion of the distal end 56 alternatingly opening and closing the inlet port 28 and the outlet port 30 periodically in a synchronous manner relative to the reciprocating motion of the piston. Thus, the inlet port 28 is opened (and the outlet port 30 is closed) during a time increment ("intake stroke") in which the piston 12 is being pulled axially away from the first axial end 38, resulting in aspiration of fluid into the bore 24 via the passageway and inlet port 28. At completion of the intake stroke (bottom dead center), the piston 12 rotates to close the inlet port 28 and to open the outlet port 30. The discharge stroke occurs during the subsequent time increment in which the piston 12 is being "pushed" axially toward the first axial end 38, resulting in expulsion of fluid from the bore 24 via the passageway and outlet port 30. At completion of the discharge stroke (top dead center), the piston 12 rotates to close the outlet port 30 and open the inlet port 28. Thus, the rotary "valving" performed by the piston 12 relative to the ports 28, 30 is synchronized with the linear motion of the piston in the bore 24.

The magnet cup 20 is nested coaxially in the motor stator assembly 22 that surrounds the magnet cup. The motor stator assembly 22 comprises a first stator portion 60 and a second stator portion 62 arranged in tandem along the axis A. Each stator portion 60, 62 comprises multiple respective electrical windings 60*a*, 60*b* and 62*a*, 62*b* that produce, whenever the respective stator portion is being electrically energized, a respective rotating magnetic field that couples to the magnetic field produced by the magnet 18. Thus, the magnet 18 is a "driven magnet" that responds directly to the particular magnetic field, to which the magnet is coupled, being produced at a given instant by one or the other of the first and second stator portions 60, 62.

The first and second stator portions 60, 62 are electrically energized in sequence, which causes axial displacement of the magnet 18. That is, energization of the first stator portion 60 is accompanied by de-energization of the second stator portion 62, resulting in a magnetic field being applied (by the first stator portion) to the magnet 18 in a manner attracting the magnet to move axially toward the first stator portion and hence perform a discharge stroke. Similarly, energization of the second stator portion 62 is accompanied by de-energization of the first stator portion 60, resulting in a magnetic field being applied (by the second stator portion) to the magnet 18 in a manner attracting the magnet to move axially toward the second stator portion and hence perform an intake stroke. Thus, reciprocating motion of the magnet 18 (and hence of the piston 12) is achieved by sequentially energizing the stator portions 60, 62. Accompanying rotational motion of the magnet 18 (and hence of the piston 12), as described below, is achieved by energizing the windings 60*a*, 60*b*, 62*a*, 62*b* of the respective stator portion 60, 62 in a manner that generates a rotating magnet field. By coordinating the sequential energizations of the stator portions 60, 62 with the sequential energizations of the respective windings 60*a*, 60*b*, 62*a*, 62*b* of the stator portions, the desired combination of reciprocating motion and rotational motion of the magnet 18 (and hence of the piston 12) is achieved.

Figure 2A:
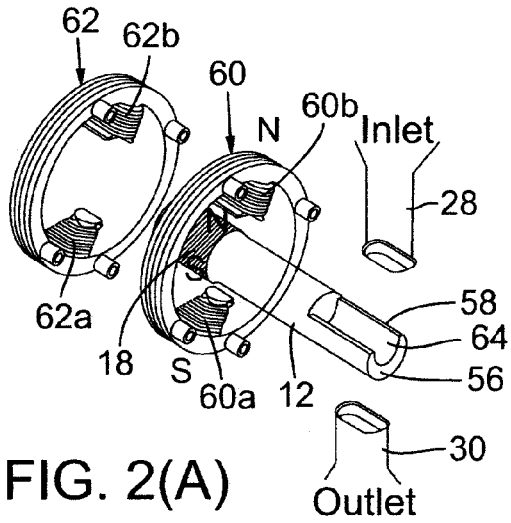
FIGS. 2(A)-2(E) are isometric drawings showing an exemplary series of piston motions produced by an external stator assembly that is magnetically coupled to the magnet attached to the piston in the FIG. 1 embodiment.
Figure 2B:
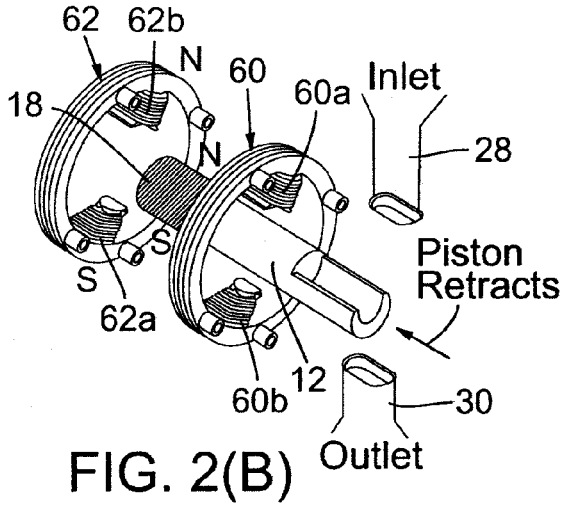
Figure 2C:
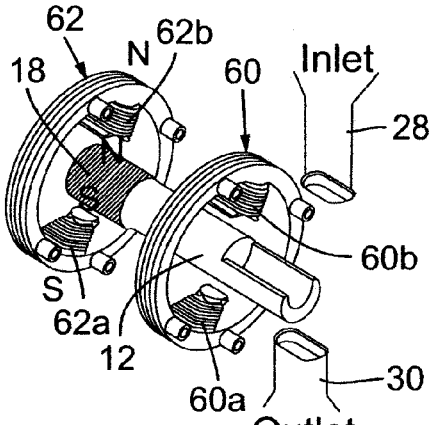
Figure 2D:
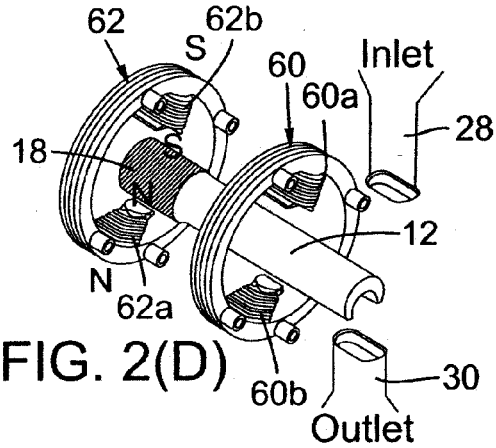
Figure 2E:
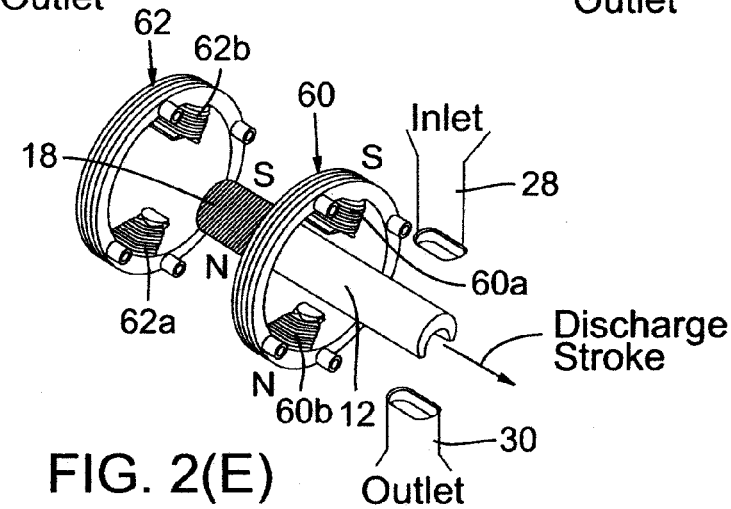

This process is depicted in FIGS. 2(A)-2(E). In FIG. 2(A) the piston 12 is at top dead center and the inlet port 28 is open to allow filling of the bore. The second stator portion 62 is not energized while the windings 60*a*, 60*b* of the first stator portion 60 are electrically energized to have a magnetic-pole orientation corresponding to an "open" inlet port 28. In FIG. 2(B) the first stator portion 60 is de-energized and the windings 62*a*, 62*b* of the second stator portion 62 are electrically energized in the same pole orientation as was just produced by the first stator portion 60. The resulting magnetic field moves the magnet 18 (and the piston 12) toward the second stator portion 62 in a manner causing filling of the bore (intake stroke). In FIG. 2(C) the piston 12 is at bottom dead center and is fully retracted, indicating completion of the intake stroke. In FIG. 2(D) the windings 62*a*, 62*b* of the second stator portion 62 are energized so as to reverse their polarity, thereby rotating the magnetic field applied by the second stator portion 62 by 180° and urging a corresponding rotation of the magnet 18 (and the piston 12) about the axis A to close the inlet port 28 and open the outlet port 30. In FIG. 2(E), the discharge stroke commences by de-energizing the second stator portion 62 and energizing the windings 60*a*, 60*b* of the first stator portion 60 in the same pole orientation as was just produced by the second stator portion 62. The resulting magnetic field moves the magnet 18 (and the piston 12) toward the first stator portion 60 in a manner causing discharge of fluid from the bore (discharge stroke). To return to the situation shown in FIG. 2(A), the windings 60*a*, 60*b* of the first stator portion 60 are energized so as to reverse their polarity, thereby rotating the magnetic field applied by the first stator portion by 180° and urging a corresponding rotation of the magnet 18 (and the piston 12) about the axis A to close the outlet port 30 and open the inlet port 28. This cycle is repeated over and over to produce a sustained pumping action. During these repetitions of the cycle, the actual pumping rate exhibited by the pump 10 is determined by the volume of fluid drawn into the bore during each intake stroke and the number of cycles completed per unit time.

In this embodiment as depicted (see FIG. 2(A)), the distal end 56 of the piston 12 not only has a flat 58 but also the flat itself is hollowed out further to form a substantially semi-cylindrical "cup" 64. The cup 64 can provide easier intake and discharge, and hence more efficient pumping, especially of viscous liquids. For other pumping applications, a simple flatted piston 12 works fine. In addition to configuring the distal end 56 of the piston 12 in any of the manners described above, the inlet port 30 can be elongated in the axial direction (see FIG. 2(A), for example) to enhance ready flow of fluid through the inlet port, such as when pumping viscous liquids.

Figure 3A:
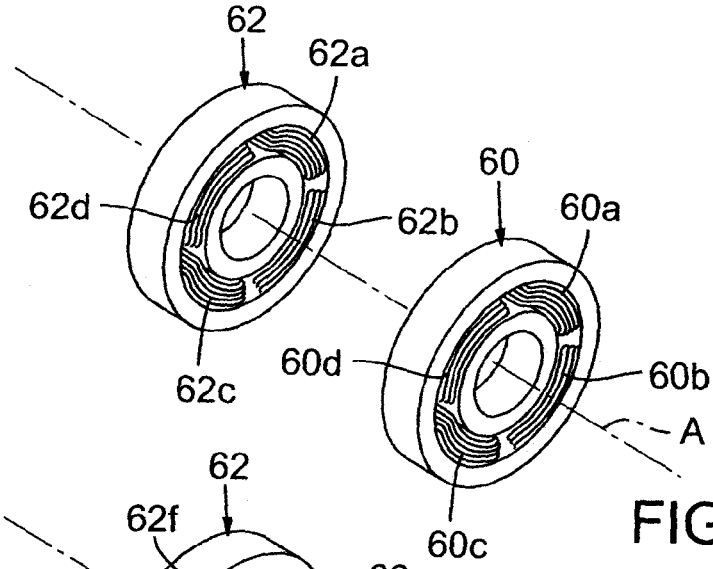
FIGS. 3(A)-3(C) are isometric depictions of alternative configurations of stator portions of a stator assembly comprising two stator portions, the stator portions in each figure having a different number of windings.

In the embodiment described above, each of the first and second stator portions 60, 62 comprises two respective windings 60*a*, 60*b* and 62*a*, 62*b* situated at 180° (around the axis A) relative to each other. As a result, each change in polarity of the windings in a stator portion causes a 180° rotation of the magnet 18 (and piston 12). Under certain conditions, rotations of the magnet 18 in 180° increments may be difficult to achieve. Hence, in an alternative embodiment, as shown in FIG. 3(A), each of the first and second stator portions 60, 62 comprises more than two windings (e.g., four each, arranged 90° apart; items 60*a*-60*d* and 62*a*-62*d*) to provide a more incremental (and hence more controlled) rotation of the magnet 18 (and piston 12). Thus, each 180° rotation of the magnet 18 is achieved by a sufficiently rapid sequential energization of the windings that results in two successive 90° rotations.

Figure 3C:
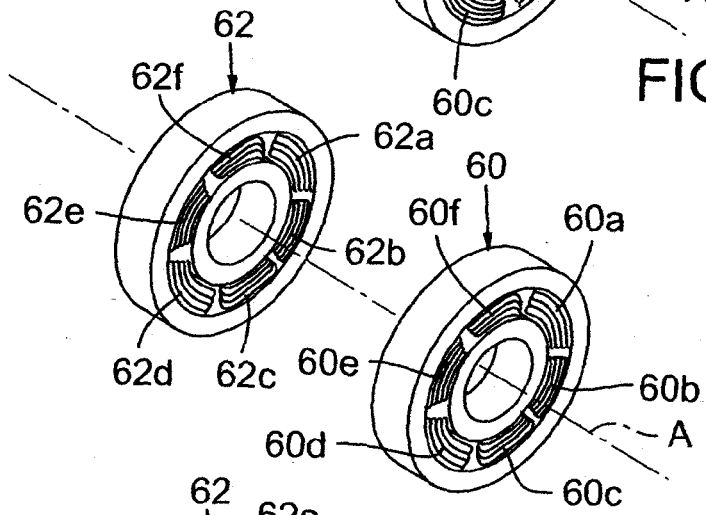
Figure 3B:
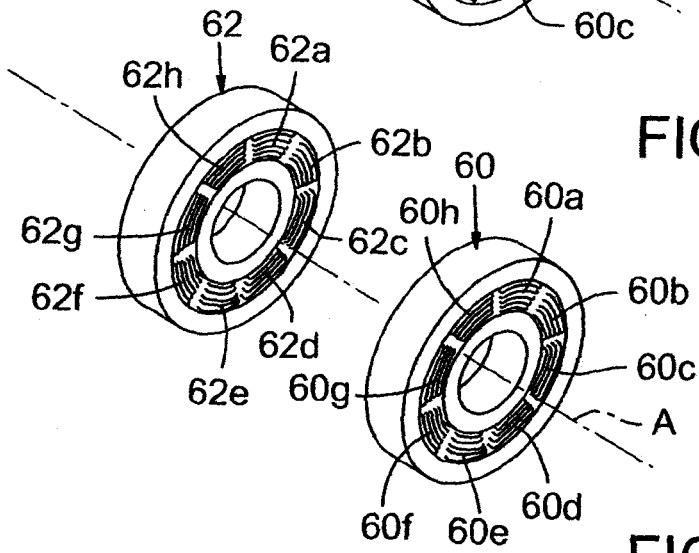

In other embodiments, the number of windings in each stator can be increased still further. For example, each stator portion 60, 62 can be provided with eight windings 60*a*-60*h*, 62*a*, 62*h* as shown in FIG. 3(B), wherein each 180° rotation of the magnet 18 is achieved by a sufficiently rapid sequential energization of the windings that results in four successive 45° rotations. In another example embodiment, each stator portion 60, 62 can be provided with six windings 60*a*-60*f*, 62*a*-62*f*, as shown in FIG. 3(C), wherein each 180° rotation of the magnet 18 is achieved by a sufficiently rapid sequential energization of the windings that results in three successive 60° rotations. Thus, it will be understood that the number of windings per stator portion 60, 62 can be established as required or desired for a particular pumping application.

Figure 4:
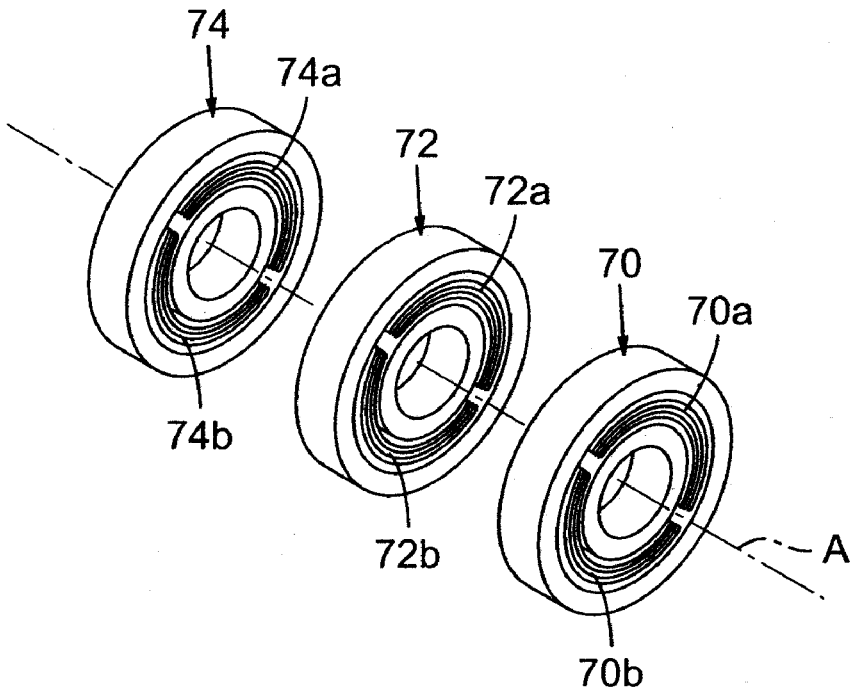
FIG. 4 is an isometric depiction of an alternative embodiment of a stator assembly comprising three stator portions.

Also, the number of stator portions arranged along the axis is not limited to two. By way of example, FIG. 4 depicts three stator portions 70, 72, 74 (each with two respective windings 70*a*, 70*b*; 72*a*, 72*b*; 74*a*, 74*b*). More than three stator portions alternatively can be used. In arrangements of more than two stator portions, the individual stator portions are sequentially energized to cause axial movement of the magnet 18 (and hence of the piston 12). Providing more than two stator portions arranged along the axis A can be effective especially for pumps having long strokes, for pumps intended for use in pumping viscous liquids, and/or for pumps having a relatively large pressure drop across the inlet port 28. It is also possible, especially when using more than two stator portions having more than two windings each, to coordinate the sequential energization of the stator portions with the energization of respective windings in each energized stator portion so as to achieve both a desired angular rotation of the magnet (and piston) and a desired axial movement of the magnet (and piston) every time a particular stator portion in the sequence is energized.

Controlled sequential energizations of the windings in each stator portion, and of the stator portions themselves, is achieved by an appropriate driver circuit 80 as well-known in the art. The driver circuit 80 can be located in a separate module electrically connected (e.g., by a cable) to the stator portions. Alternatively, for example, the driver circuit 80 can be contained in a housing mounted tandemly to the stator portions.

In another alternative embodiment, the magnet 18 (and thus the piston 12) is driven using a driving magnet attached to the armature of a motor. The armature of the motor rotates the driving magnet about the axis A. Meanwhile, the driving magnet is cammed or otherwise configured to undergo reciprocating motion, along the axis A, that is synchronized with the rotational motion about the axis A. These combined motions of the driving magnet outside the magnet cup 20 are coupled magnetically to the magnet 18 inside the magnet cup, and thus to the piston 12 in the bore 24.

Figure 5:
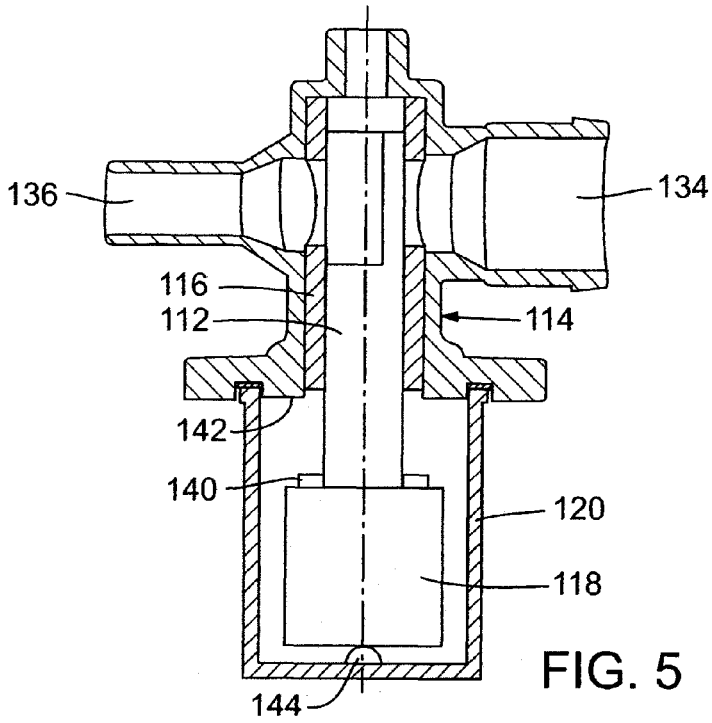
FIG. 5 is a sectional view of a valveless piston pump according to an alternative embodiment.
Figure 6:
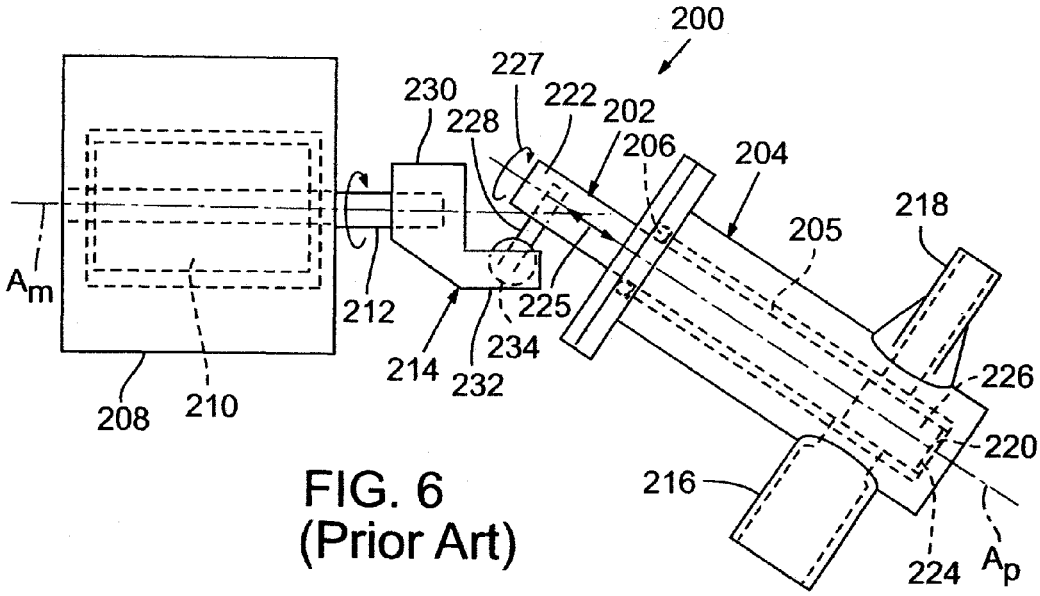
FIG. 6 (Prior Art)
FIG. 6 shows a conventional valveless piston pump, of which the piston is externally driven in a manner requiring a dynamic seal.

In FIGS. 1 and 2(A)-2(E), the magnet 18 is depicted as having substantially the same outside diameter as the piston 12. In alternative embodiments the piston and magnet can have different diameters. For example, reference is made to the embodiment shown in FIG. 5, in which the magnet 118 has an outside diameter that is greater than the outside diameter of the piston 112. Other details of the embodiment shown in FIG. 5 are substantially similar to the embodiment of FIG. 1, including the pump housing 114, the liner 116, the magnet cup 120, and the bore 124. The magnet cup 120 is suitable for coaxial placement of a motor stator or the like (not shown), in the manner shown in FIG. 1, for driving the piston in synchronous reciprocating and rotational motions. A larger-diameter magnet as shown can be advantageous if, for example, it is desired to provide the magnet with more than two poles. A larger-diameter magnet also may be advantageous for use with a stator having more than two windings. Also, a larger-diameter magnet may be advantageous for achieving a stronger magnetic coupling with a magnet-driving device such as a stator.

In the embodiment shown in FIG. 1, for example, it is desirable to include means for ensuring that rotation of the magnet 18 (and hence of the piston 12) consistently occurs in the same direction during operation of the pump 10 and for facilitating beginning of rotation of the magnet and piston after each change of polarity of the energized stator portion. An exemplary means in this regard comprises one or more shaded poles in the stator portions 62*a*, 62*b*. Shaded poles are used in a variety of motors. For example, in a single-phase induction motor, a shaded pole produces a rotating magnetic field that is useful for starting rotation of the motor armature. The shaded pole typically comprises a conductive ring or coil (called a "shading coil," usually made of one or more windings of copper) that is incorporated into each field pole (usually in a respective notch) of the stator. Current in the shading coil delays the phase of magnetic flux in that part of the pole sufficiently to provide a rotating field. By incorporating shaded poles into the stator portions 62*a*, 62*b*, the field produced by each shaded pole is summed with the field from the non-shaded portion of the corresponding pole, yielding a resultant field that does not exactly oppose the magnetic field produced by the magnet 18. I.e., the "N" and "S" poles in the stator do not coincide with the "N" and "S" poles of the magnet 18 immediately after switching polarity in the energized stator portion. This allows some rotational torque to develop to assist the rotation of the magnet immediately after reversing the polarity of the respective stator portion.

In certain embodiments it is desirable to incorporate one or more Hall sensors or analogous devices to provide data on the timing of rotation and/or displacement of the magnet 18. Incorporating such sensors can be especially advantageous when using the pump for pumping a viscous fluid.

Certain applications of the subject pumps may require more accurate control of the stroke length of the piston 12 than can be achieved using only the magnetic fields produced by the stator portions. Hence, with certain embodiments (for example, in "metering pump" applications), it is desirable to include means for accurately and precisely controlling the stroke length of the piston. An exemplary means in this regard comprises first and second "stops" that collective provide an exactly defined axial space in which the piston is allowed to move. For example, the first and second stops can be situated and configured such that the piston 12 "bumps" against a respective stop at each of top dead center and bottom dead center. One embodiment is shown in FIG. 5, in which the piston 112 includes a collar 140 that, when the piston is at bottom dead center, engages the surface 142 of the housing 114 and stops axial motion of the piston, and a bumper 144 inside the magnet cup 120 that, when the piston is at top dead center, engages the magnet 118. (Alternatively, the bumper 144 can be mounted on the magnet 118 so as to engage the inside surface of the magnet cup.) An alternative means comprises a cam track in which a follower, coupled to the piston, is engaged.

Whereas certain embodiments described above utilize circular stator portions that comprise coils on the salient poles, an alternative type of stator would be a "C"-shaped stator that has a single coil wound around the stem of the "C." These alternative types of stators can be manufactured for less cost than, but nevertheless are equivalent to, the two-pole shown, for example, in FIGS. 2(A)-2(E).

Yet other embodiments utilize, for driving the piston in the desired coordinated rotational motion and reciprocating motion, a particular type of motor that produces both of these motions of an armature, for example. These motors have several names in the art, including "skew motors" and "axially oscillating motors." In certain embodiments the motor can have an armature that is magnetically coupled to the magnet 18 so that the magnet undergoes the same motions as the armature. In certain other embodiments, the stator of such a motor can be used without an armature (but nevertheless magnetically coupled to the magnet).

In view of the many possible embodiments to which the principles of the disclosed technology may be applied, it should be recognized that the illustrated embodiments are only currently preferred examples of the disclosed technology and should not be taken as limiting the scope of the disclosed technology. Rather, the scope of the disclosed technology is defined by the following claims and their equivalents. We therefore claim all that comes within the scope and spirit of these claims.

What is claimed is:

1. A piston pump, comprising:

a sealed housing assembly defining a bore having a bore axis;

a piston situated in the bore so as to be movable in the bore in a reciprocating manner along the bore axis and in a rotational manner about the bore axis; and a magnet situated in the bore and coupled in the bore to the piston, the magnet being engageable magnetically with a magnet-driving device that is situated outside the housing and that is configured to cause the magnet, and thus the piston, to move together in the bore in the reciprocating manner and in the rotational manner.

2. The piston pump of claim 1, wherein the magnet-driving device comprises a stator assembly situated coaxially with the magnet.

3. A piston pump, comprising:

a sealed housing defining a bore extending along an axis, the housing having an inlet port and an outlet port extending into the bore;

a piston situated coaxially in the bore in a manner allowing the piston to undergo, in the bore, rotational motions about the axis and reciprocating motions along the axis, the reciprocating motions corresponding to alternating intake strokes and discharge strokes of the piston, and the rotational motions allowing the piston to open and close the inlet and outlet ports in coordination with the intake and discharge strokes;

a magnet mounted to and movable with the piston in the bore, the magnet producing a magnetic field; and a magnet cup defining a bore enclosing the magnet, the magnet cup being sealingly attached to the housing such that the bore of the housing is contiguous with the bore of the magnet cup, the magnetic field of the magnet being engageable with a magnet-driving device located outside the magnet cup.

4. The piston pump of claim 3, wherein the magnet-driving device is configured to cause the coordinated reciprocating and rotational motions of the magnet, and thus of the piston, in the bore.

5. The piston pump of claim 4, wherein:

the magnet-driving device comprises a stator assembly comprising at least two stator portions each comprising at least two windings; and the stator portions are situated coaxially outside the magnet cup at respective locations along the axis so as magnetically to engage the magnet and to cause, when the stator portions and their respective windings are energized in a coordinated manner, the corresponding coordinated reciprocating and rotational motions of the piston and magnet in the bore.

6. The piston pump of claim 5, wherein each of the stator portions comprises at least one respective shaded pole.

7. The piston pump of claim 3, wherein the magnet cup is sealed to the housing by a static seal.

8. The piston pump of claim 3, wherein the magnet is axially mounted to the piston.

9. The piston pump of claim 3, wherein:

the bore and piston are cylindrical; and the piston slip-fits in the bore.

10. The piston pump of claim 3, wherein the bore of the housing is contiguous with the bore of the magnet cup along the axis.

11. The piston pump of claim 3, wherein:

the piston has a proximal end and a distal end;

the proximal end is coupled to the magnet; and the distal end is configured to open and close the inlet and outlet ports in an alternating manner in synchrony with the intake and discharge strokes.

12. The piston pump of claim 3, further comprising means for limiting an axial stroke length of the piston.

13. A piston pump, comprising:

housing means for defining a sealed bore having a bore axis and for defining an inlet into the bore and an outlet from the bore;

piston means, situated in the bore in a manner allowing movement in a reciprocating manner along the bore axis and in a rotational manner about the bore axis, for producing with such movements a coordinated positive-displacement pumping action that moves fluid into the bore via the inlet and delivers fluid from the bore via the outlet;

driven-magnet means, coupled to the piston means in the bore, for imparting the movements to the piston means in the bore; and magnet-driving means, located outside the bore and being magnetically coupled to the driven-magnet means, for imparting the movements to the driven-magnet means and hence to the piston means in the bore, to produce the coordinated positive-displacement pumping action.

14. The piston pump of claim 13, wherein said magnet-driving means comprises stator means located outside the housing means coaxially with the bore axis.

15. The piston pump of claim 14, wherein said stator means comprises shaded-pole means for achieving consistent rotational direction of the piston about the bore axis.

16. The piston pump of claim 13, further comprising means for limiting a stroke length of the piston along the bore axis in the housing means.

17. A method for moving fluid, comprising:

magnetically coupling a piston, located and movable within a sealed bore defined by a sealed pump housing assembly, to a magnetic field produced outside the bore, the magnetic field being changeable to impart corresponding motions to the piston in a coordinated manner about and along a longitudinal axis of the bore;

changing the magnetic field as appropriate to move the piston in the bore about the axis so as to open an inlet into the bore;

changing the magnetic field as appropriate to move the piston in the bore along the axis so as to draw fluid into the bore via the inlet;

changing the magnetic field as appropriate to move the piston in the bore about the axis so as to close the inlet and open an outlet from the bore; and changing the magnetic field as appropriate to move the piston in the bore along the axis so as to expel fluid from the bore via the outlet.

18. The method of claim 17, wherein magnetically coupling the piston to the changeable magnetic field outside the bore comprises:

attaching the piston to a magnet in the bore; and magnetically coupling the magnet to the changeable magnetic field outside the bore.

19. The method of claim 18, wherein the magnet is coupled to a changeable magnetic field produced by a stator assembly arranged along the axis outside the bore.

* * * * *